United States Patent [19]

Takebe

[11] Patent Number: 4,683,349

[45] Date of Patent: Jul. 28, 1987

[54] ELASTIC ELECTRIC CABLE

[76] Inventor: Norichika Takebe, 11-go, 5-ban, Taiheji 2-chome, Kashihara-shi, Osaka, Japan

[21] Appl. No.: 779,962

[22] Filed: Sep. 25, 1985

[30] Foreign Application Priority Data

Nov. 29, 1984 [JP] Japan ..... 59-252484
Jan. 21, 1985 [JP] Japan ..... 60-7126[U]

[51] Int. Cl.[4] ..... H01B 7/06
[52] U.S. Cl. ..... 174/69; 174/113 C
[58] Field of Search ..... 174/69, 113 C, 131 A

[56] References Cited

U.S. PATENT DOCUMENTS

| | | | |
|---|---|---|---|
| 53,430 | 3/1866 | Field | 174/69 |
| 1,977,209 | 10/1934 | Sargent | 174/131 A X |
| 2,175,389 | 10/1939 | Hanff | 174/69 |
| 2,386,753 | 10/1945 | Shield | 174/131 A X |
| 3,014,087 | 12/1961 | Kaplan | 174/113 C X |
| 3,048,078 | 8/1962 | Kaplan | 174/69 X |
| 3,100,240 | 8/1963 | McKirdy | 174/113 C X |
| 3,277,231 | 10/1966 | Downey et al. | 174/69 X |
| 3,823,253 | 7/1974 | Walters et al. | 174/113 C X |

FOREIGN PATENT DOCUMENTS

| | | | |
|---|---|---|---|
| 990374 | 6/1976 | Canada | 174/109 |
| 2408707 | 9/1974 | Fed. Rep. of Germany | 174/113 C |
| 976516 | 10/1950 | France | 174/69 |
| 11163 | of 1908 | United Kingdom | 174/69 |

*Primary Examiner*—Laramie E. Askin
*Attorney, Agent, or Firm*—Birch, Stewart, Kolasch & Birch

[57] ABSTRACT

A core cable is composed of a core member, a conductor spirally wound around the core member, and an insulator covering the outer surface of a layer of the spirally wound conductor. For the core member and insulator, elastic and deformable materials are used, and the core member, conductor, and insulator stretch and contract integrally with each other. When using a non-elastic core member and insulator, a plurality of core cables are spirally wound together to be formed like a coil and then covered with an elastic and deformable sheath so as to be finished into a single line of cable which stretches and contracts due to elasticity of coil-like cables and sheath.

57 Claims, 35 Drawing Figures

ELASTIC ELECTRIC CABLE

BACKGROUND SUMMARY OF THE INVENTION

This invention relates to an elastic electric cable required for wiring in mechatronic apparatus such as articulated robots, transferable machines, and electronic apparatus.

Demand for the elastic cable has been raised since former days and, in response to this demand, spiral elastic cables composed of wires wound into a coil have been offered for use. With the recent development of mechatronic industry using robots, the abovesaid spiral cable have come into use as lead wires for transferable apparatus such as multi-joint arm apparatus, linearly reciprocating one, revolving one, twisting one, lifting one, and vibrating one or as an interface cable between electronic apparatus as computers. This kind of spiral elastic cable, however, has been followed by a drawback that the rate of elongation is low (only twice at the maximum) in proportion to a large outer diameter of the spiral of cable (about three times as much as the diameter of a straight cable). For increasing elasticity of the spiral cable, it is necessary to increase a diameter of the spiral or a length thereof. Accordingly, this type of spiral cable cannot be used for wiring in a narrow space such as the inner part of the robot arm and, when applied to wiring outside the apparatus, becomes obstructive because of a great length thereof. An increase in diameter of the spiral part and length of the cable leads to decrease in elasticity and prevents the use of the cable itself.

It is, therefore, an object of this invention is to provide an elastic electric cable which is capable of expanding and contracting while remaining straight, is small in diameter, and can be manufactured at low cost.

Another object of this invention is to provide an elastic electric cable which is in the shape of coiled spring (i.e., spiral) and further elastic even after stretched from spiral to approximate straight line in configuration.

Other objects, features, and advantages of this invention will become apparent from the accompanying drawings and the detailed description that will be made later.

BRIEF DESCRIPTION OF THE DRAWINGS

In the accompanying drawings:

FIG. 5A is a partially broken perspective view of a modification of the cable of FIG. 5A;

DESCRIPTION OF THE PREFERRED EMBODIMENTS

Figure 1A:
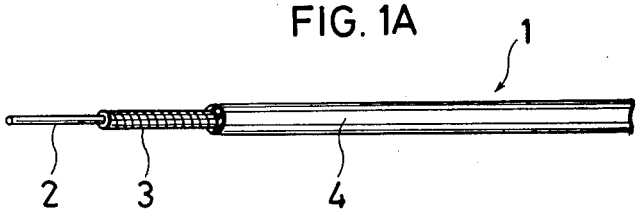
FIG. 1A is a partially broken perspective view of a cable according to a first embodiment of this invention.
Figure 1B:
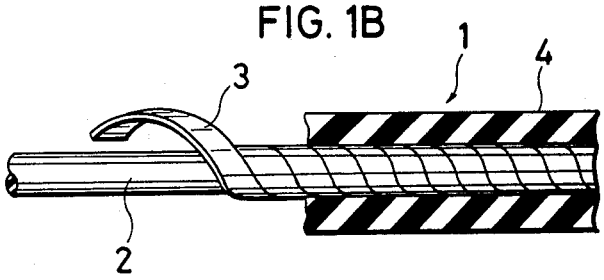
FIG. 1B is an enlarged vertical sectional view of the main part of the cable of FIG. 1A.
Figure 1C:
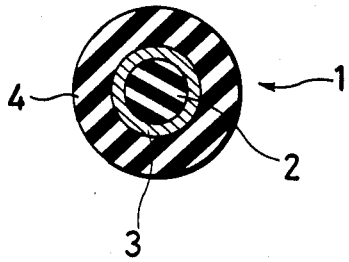
FIG. 1C is an enlarged cross-sectional view of the cable of FIG. 1A.

With reference to the drawings, a detailed description will be made.

FIGS. 1A to 1D inclusive are views of a first embodiment of this invention, wherein the reference numeral 1 indicates an elastic electric cable composed of a linear core member 2 made of an elastic and deformable material, a conductor 3 spirally wound around the core member 2, an insulator 4 made of an elastic and deformable material similarly to the core member 2 and covering the outer surface of a layer of spirally would conductor 3. The conductor 3 shown in the drawing is such a one that made of a wire which was initially round in cross-section, has been rolled into a thin band (a so-called band-like foil), and is wound around the core member 2 in the non-stretched state, like a coil with close pitches. The insulator 4 as an outer layer is subjected to extrusion molding for covering the inner members. It is also preferable to use various types of conductors 3 as shown in FIGS. 2A to 2E according to the required electric capacity. That is to say, FIG. 2A shows two thin band-like conductors 3 laminated together and wound around the core member 2, FIG. 2B showing two thin band-like conductors 3 arranged in parallel with each other and wound around the core member 2 and FIG. 2C showing four thin band-like conductors 3 out of which the laminated two are arranged in parallel with the other laminated two and wound around the core member 2 altogether. In the cases as shown in FIGS. 2A to 2C, an increase in the number of conductors 3 is optional. FIG. 2D shows a plurality of cross-sectionally round conductors 3 arranged in parallel with each other and wound around the core member 2 and FIG. 2E shows a plurality of similar round conductors 3 arranged in parallel with each other and wound around a layer of a plurality of previously wound similar conductors 3. In the case of FIGS. 2D and 2E, too, an increase or decrease in the number of conductors 3 is optional.

As elastic materials for the core member 2 and insulator 4, used are a variety of restitutive polymers such as butyl, neoprene, styrene-butadiene, nitrile, polyurethane, and silicone rubbers, and, above all, polymers of copolymer and blend types are preferable because of less deterioration in elasticity.

Figure 1D:
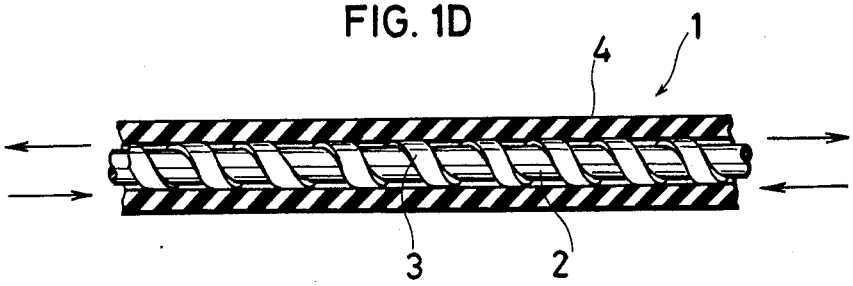
FIG. 1D is an enlarged vertical sectional view of the cable of FIG. 1A when stretched.
Figure 2A:
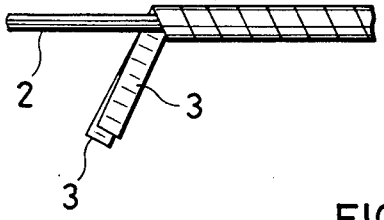
FIGS. 2A to 2E inclusive are plan views of conductors used in this invention.
Figure 2B:
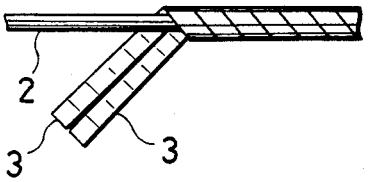
Figure 2C:
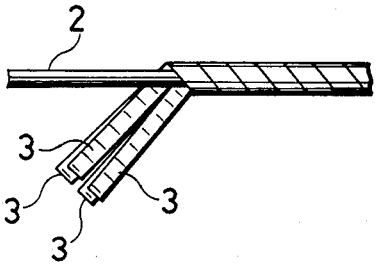
Figure 2D:
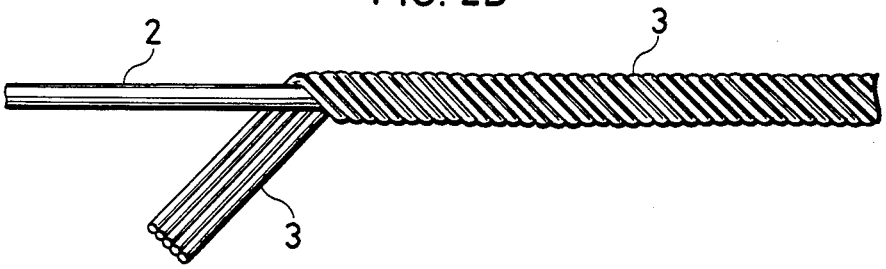
Figure 2E:
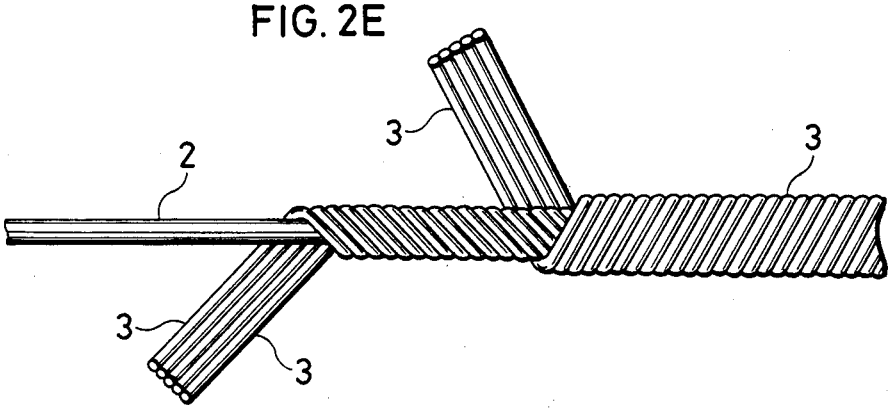

An elastic cable composed as above, in which the core member 2, conductors 3, and insulator 4 expand and contract integrally with each other and uniformly, assumes a configuration while stretched as shown in FIG. 1D. It is possible to make up an extremely fine elastic cable 1 having an outer diameter of 1 mm or under in such a structure as above. (On trial, a cable of 0.3 mm diameter was successfully obtained.)

Figure 3:
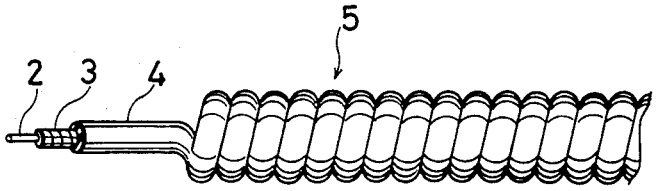
FIG. 3 is a partially broken perspective view of a second embodiment of a cable according to this invention.

FIG. 3 shows a 2nd embodiment of this invention, wherein an elastic cable 5 is composed of elastic cables 1 referred to as the 1st embodiment and wound at close pitches to be formed like a coiled spring. The description of other structures will be omitted because of similarity thereof to that of the 1st embodiment.

An elastic cable 5 as the 2nd embodiment is in the shape of coil and therefore large in outer diameter, however, structurally capable of stretching straight along the axis thereof, not the axis of coil, in addition to be elastic due to the coil, in addition to be elastic due to the coil-like shape thereof, and, accordingly, can be stretched further even after stretched to almost the loss of coil-like shape, thereby exhbiting a higher rate of elasticity.

Figure 4:
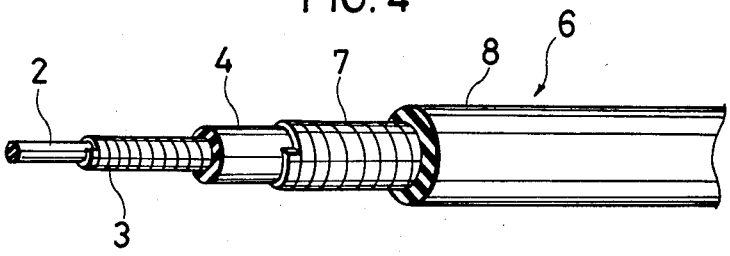
FIG. 4 is a partially broken perspective view of a cable according to a third embodiment of this invention.

FIG. 4 is a view showing a 3rd embodiment of this invention, wherein an elastic cable 6 is composed in such a way that the elastic cable 1 as the 1st embodiment is covered with an outer conductor 7 for noise prevention spirally wound around an insulator 4 and further with a sheath 8 made of restitutive polymer identical to that used for the core member 2 and insulator 4.

The outer conductor 7 that is shown in the drawing is a thin rolled band-like foil. Specially for the sheath 8, resistance to environment (resistance to heat, cold, wear, bending, etc.) is required and it is preferable to select materials meeting the purpose of use from the abovesaid restitutive polymeric ones. An outer conductor 7 may be round in cross-section like the previously described conductor 3.

A cable of this embodiment can be stretched while remaining straight in the same way as in the case of the 1st embodiment and prevents noise generation.

Figure 5A:
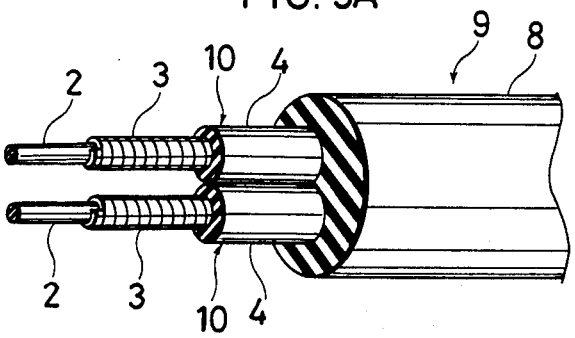
FIG. 5A is a partially broken perspective view of a cable according to a fourth embodiment of this invention.
Figure 5B:
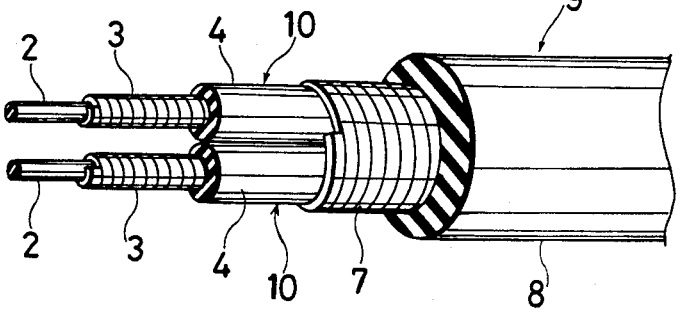

FIG. 5A shows a 4th embodiment of this invention, wherein an elastic cable 9 composed of a plurality (two in the drawing) of elastic cables, (called core cables in this embodiment) each corresponding to the cable 1 in the 1st embodiment, aligned in parallel with each other and covered with a sheath 8 made of restitutive polymeric material identical to that used in the 3rd embodiment. It is preferable, as shown in FIG. 5B, to interpose an outer conductor 7 for noise prevention between a pair of core cables 10 and 10 and the sheath 8 so as to cover these cables.

The cable of this embodiment, too, can be elastic even after stretched straight similarly to the 1st embodiment.

Figure 6:
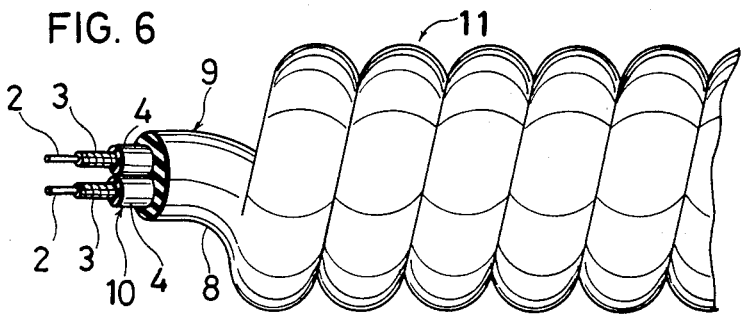
FIG. 6 is a partially broken perspective view of a cable according to a fifth embodiment of this invention.

FIG. 6 is a view of a fifth embodiment, wherein an elastic cable 11 is composed of the elastic cable 9 as the 4th embodiment spirally wound at close pitches like a coiled spring.

This cable is elastic along the axis of not only the coil but also the cable itself similarly to the 2nd embodiment, and can further expand even after stretched almost straight, thereby exhibiting a high rate of elasticity.

Figure 7A:
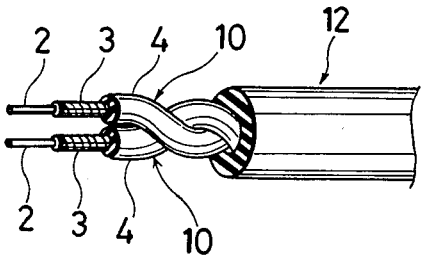
FIG. 7A is a partially broken perspective view of a cable according to a sixth embodiment of this invention.
Figure 7B:
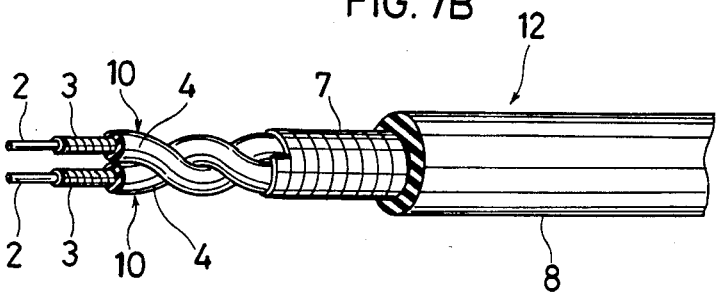
FIG. 7B is a partially broken perspective view of a modification of the cable of FIG. 7A.

FIG. 7A shows a 6th embodiment, wherein an elastic cable 12 is composed of a plurality of core cables 10 and 10 twisted together and covered with a sheath 8 made of a restitutive polymeric material. In this embodiment, too, it is preferable to interpose an outer conductor 7 for noise prevention, as shown in FIG. 7B, between a pair of core cables 10 and 10 and the sheath 8 so as to cover these core cables 10 and 10 similarly to the 4th embodiment.

This cable can expand while remaining straight similarly to the 1st and 4th embodiments.

Figure 8:
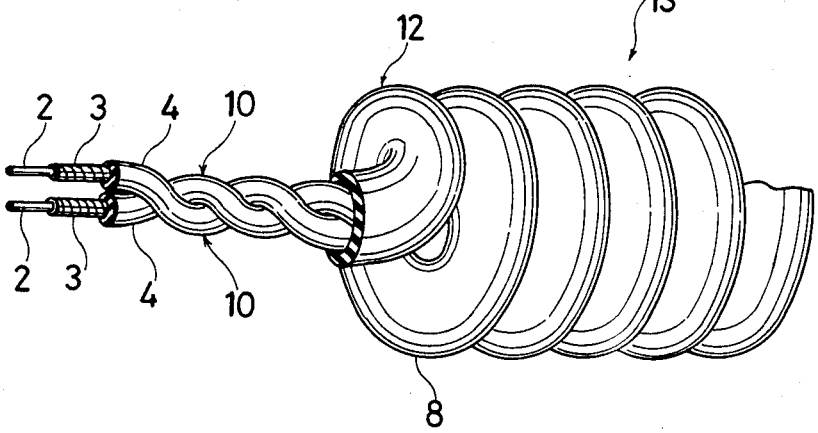
FIG. 8 is a partially broken perspective view of a cable according to a seventh embodiment of this invention.

FIG. 8 shows a 7th embodiment, wherein an elastic cable 13 is composed of the elastic cable 12 as the 6th embodiment spirally wound at close pitches like a coiled spring.

This cable, similarly to those as the 1st and 2nd embodiments, can be elastic even after stretched almost straight.

Figure 9:
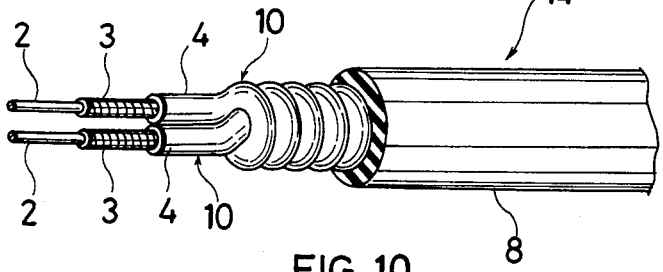
FIG. 9 is a partially broken perspective view of a cable according to an eighth embodiment of this invention.

FIG. 9 shows an 8th embodiment, wherein an elastic cable 14 is composed of a plurality of core cables 10 and 10 spirally wound together at close pitches and covered with a sheath 8 made of a restitutive polymeric material.

This cable, similarly to those as the 1st, 4th, and 6th embodiments, can expand while remaining straight.

Figure 10:
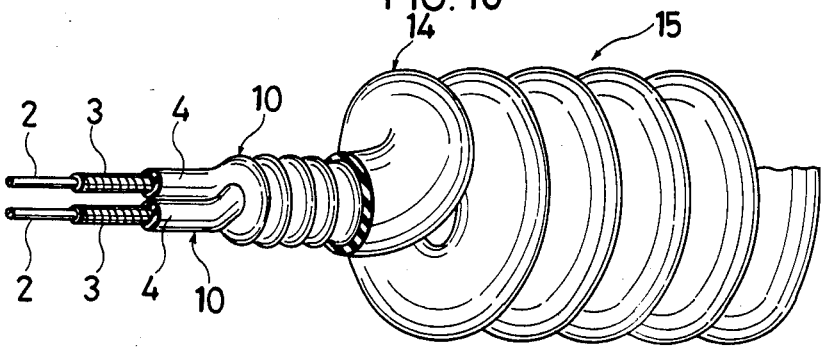
FIG. 10 is a partially broken perspective view of a cable according to a ninth embodiment of this invention.

FIG. 10 shows a 9th embodiment, wherein an elastic cable 15 is composed of the cable 14 as the 8th embodiment spirally wound at close pitches like a coiled spring.

This cable, similarly to those as the 2nd, 5th, and 7th embodiments, can expand even after stretched almost straight.

Figure 11A:
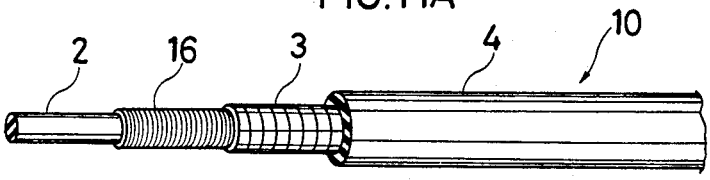
FIGS. 11A to 11C are partially broken perspective views of core cables (elastic cables) each including a yarn-composed body.
Figure 11B:
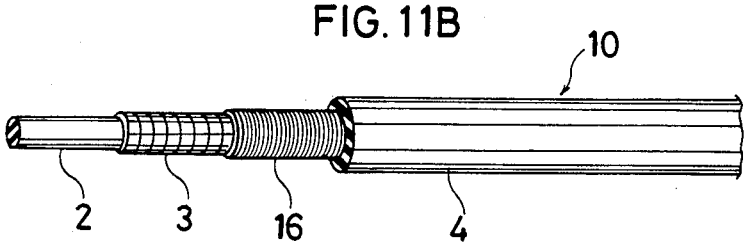
Figure 11C:
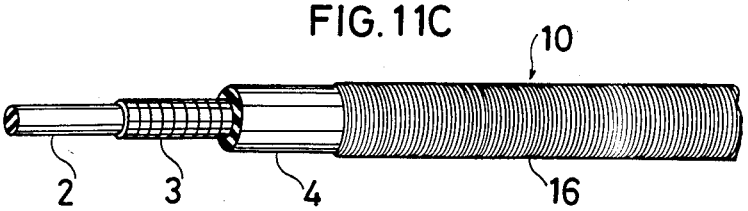

The core cable 10 (the elastic cable 1 in the 1st embodiment) in this embodiment can be reinforced, as shown in FIG. 11A, by interposing a non-elastic yarn-composed body 16 between the core member 2 and conductor 3 so as to cover the core member 2. The yarn-composed body 16 is designed to be tightened when the core cable 10 is stretched to a predetermined length. This body 16 is adapted to exert braking effect upon elongation of the core cable 10 and prevent breakage of the conductor 3. A desirable material for the yarn-composed body 16 is polyester yarn and, when the strength and heat-resistance are particularly required, the use of Aramid, nylon, or carbon fiber yarn is preferable. FIG. 11B shows the yarn-composed body 16 spirally wound around the conductor 3 and interposed between this conductor and the insulator 4. In this case, the core cable 10 is reinforced. FIG. 11C shows the yarn-composed body 16 spirally wound around the insulator 4. In this case, too, the core cable 10 is reinforced. The core cable 10 shown in FIG. 11C is used for only the 1st embodiment whereas those 10 and 10 shown in FIGS. 11A and 11B are used for the 1st to 9th embodiments inclusive. By varying the winding pitch of the yarn-composed body 16, the rate of elongation of the cable can be adjusted. The use of the yarn-composed body 16 is limited to fine cables extremely weak against stretching or to such cables for which tensile strength is specially required.

Figure 12A:
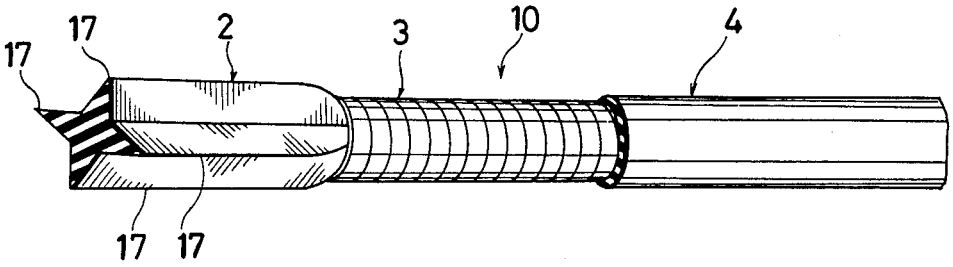
FIG. 12A is a partially broken perspective view of a modification of a core cable (elastic cable)
Figure 12B:
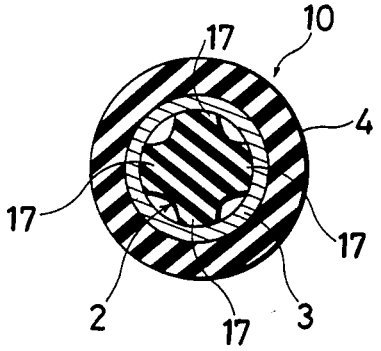
FIG. 12B is an enlarged cross-sectional view of the core cable of FIG. 12A
Figure 12C:
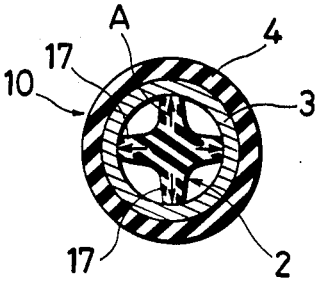
FIG. 12C is an enlarged cross-sectional view of the core cable of FIG. 12A in the stretched state.

FIGS. 12A to 12C are views showing a core cable 10 (the elastic cable 1 in the 1st embodiment) using modified core member 2 having protrusive ribs 17 triangular in cross-section provided on the periphery and extending along the axis thereof. This core member 2 is approximate to a star in cross-section. The conductor 3 is spirally wound at close pitches around the core member 2 in the non-elongated state so as to press protrusive ribs 17 of this core member 2 as shown in FIG. 12B. The conductor 3 is covered with the insulator 4.

In the core cable 10, as shown in FIG. 12C, the conductor 3 is in tight contact with the longitudinally running protrusive ribs 17 which press the conductor 3 as shown by arrow marks, whereby the relative position of the conductor 3 to the core member 2 is not varied. Therefore, the coiled conductor 3 expands at equal intervals (equal pitches). The core cable 10 (the elastic cable 1 in the 1st embodiment) including the core member 2 provided with such longitudinally running protrusive ribs 17 is used for the 1st to the 9th embodiments.

When assuming that a core member 2 having no protrusive ribs and being simply round in cross-section is used, such problems as follows may presumably arise. That is, when the cable is stretched, the diameter of the round cross-section thereof decreases and the outer peripheral surface of the core member 2 is separated from the inner surface of coiled conductor 3 wound around the core member 2. Accordingly, it is presumed that the conductor 3 may expand at irregular pitches and cause disorder of coils. (Coils locally gather at close pitches.) With the repeat of expansion and contraction in the state as above, the conductor 3 will break at early stage.

When a core member 2 provided with longitudinally running protrusive ribs 17 is used, the conductor 3 is constantly in resilient contact with the protrusive ribs 17 even when stretched and is positionally invariable relative to the core member 2. The conductor 3, therefore, elongates at equal pitches and causes no disorder of coil arrangement. Thus, an invariable orderly arrangement of coils withoug local gathering even when stretched ensures no breakage and long life of the conductor 3.

Figure 13:
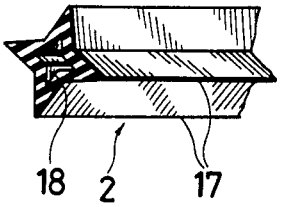
FIG. 13 is a perspective view of another embodiment of core member.

FIG. 13 shows another modification of the core member 2 which is provided with a hollow 18 longitudinally running along the axis of the member and shaped like a star at cross-section. This core member 2 is used when control over the stretching force is required, and is applicable to the 1st embodiment of the 9th one.

Figure 14:
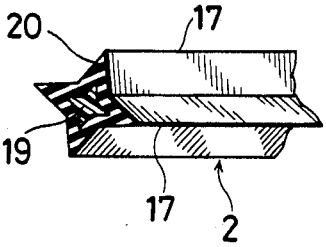
FIG. 14 is a perspective view of still another modification of core member.

FIG. 14 shows still another modification of core member 2 which is composed of an axial part 19 made of an elastic and deformable material and an outer layer part 20 made of a heat-resistant resinous material for covering the axial part 19 and provided with longitudinally running protrusive ribs 17. This core member is elastic and deformable as a whole, and a core cable 10 (the elastic cable 1 in the 1st embodiment) composed of this core member 2, conductors 3, and insulator 4 expands and contacts uniformly while keeping all the component members integral with each other, which is also suitable for soldering of conductors 3. A material of the outer layer member 20 is silicone plastic. The core cable 10 using this core member 2 is applied to the 1st embodiment of the 3rd one.

Figure 15:
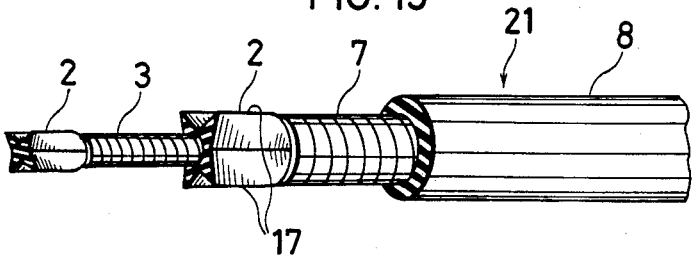
FIG. 15 is a partially broken perspective view of an elastic cable composed of a combination of the core member as shown in FIGS. 12A to 12C and that as shown in FIG. 13.

An elastic cable 21 shown in FIG. 15 is composed of a core member 2 as referred to in the description of the embodiments shown FIGS. 12A to 12C, a conductor 3 spirally wound around the abovesaid core member 2, another core member 2 as shown in FIG. 13 and covering the above two components, an outer conductor 7 for noise prevention spirally wound around the former three, and a sheath 8 covering all of the abovesaid components.

Figure 16A:
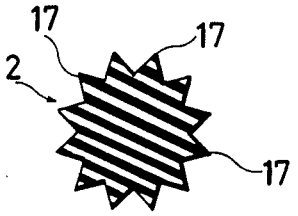
FIGS. 16A to 16E are cross-sectional views of various modifications of core members.

FIGS. 16A to 16E inclusive show cross-sections of various kinds of core members 2. FIG. 16A shows a core member around which a plurality of longitudinally running protrusive ribs 17, each being triangular in cross-section, are formed. That is, the cross-section of this core member is saw-toothed at the periphery thereof.

Figure 16B:
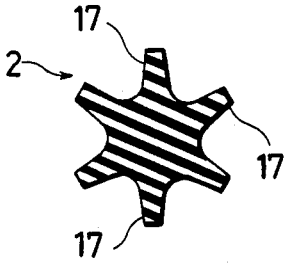
Figure 16C:
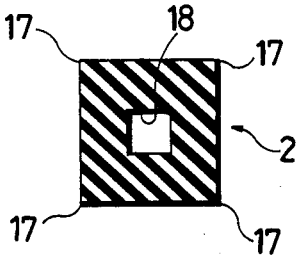
Figure 16D:
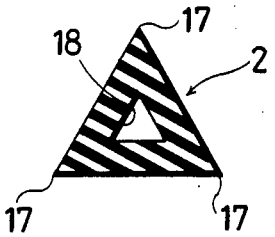
Figure 16E:
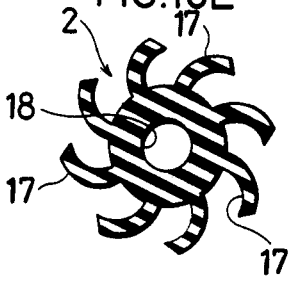

FIG. 16B shows a cross-section of a core member having a plurality of longitudinally running protrusive ribs 17, each being roughly trapezoidal, disposed on the periphery. FIG. 16C shows a square cross-section of a core member having a longitudinally running hollow 18 along the axis thereof. FIG. 16D shows a triangular cross-section of a core member having a longitudinally running hollow 18 along the axis thereof. FIG. 16E shows a cross-secton of a core member having longitudinally running protrusive ribs 17, each arcuately bending in one fixed direction at cross-section, and a longitudinally running hollow 18 circular in cross-section along the axis thereof. It is a matter of course that the abovesaid core members are all applicable to the 1st embodiment to the 9th one.

Figure 17:
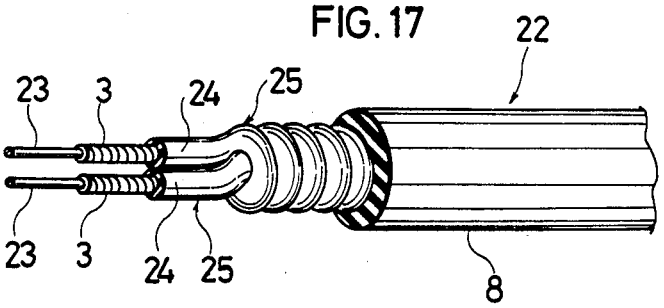
FIG. 17 is a partially broken perspective view of a cable according to a tenth embodiment of this invention; and, FIG. 18 is a partially broken perspective view of a cable according to an eleventh embodiment of this invention.

FIG. 17 shows an elastic cable 22 as the 10th embodiment which is composed of a plurality of core cables 25 and 25 arranged in parallel with each other, spirally wound together, and covered with a sheath 8 made of an elastic and deformable material, the core cables 25 and 25 each being composed of a linear core member 23, conductor 3 spirally wound around the core member 23 and insulator 24 covering the spirally wound conductor 3. As a core member 23, used is, for example, a high strength twisted yarn composed of synthetic fibers (polyester and the like). The insulator 24 is made of highly flexible synthetic rubber or plastics, not requiring stretchability. The core cables 25 and 25 are not elastic when laid straight and become elastic when spirally wound like a coil. Accordingly, this elastic cable 22 stretches while remaining straight due to the spirally wound core cables 25 and 25 and elastic sheath 8.

Figure 18:
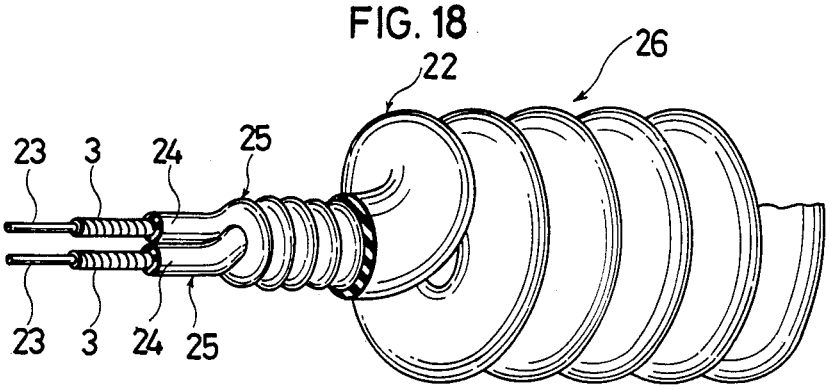

FIG. 18 shows an elastic cable 26 as the 11th embodiment which is composed of an elastic cable 22 referred to as the 10th embodiment and wound at close pitches like a coiled spring. Therefore, this elastic cable 26 can expand even after stretched almost straight similarly to the 2nd, 5th, 7th and 9th embodiments.

Elastic electric cables described as the 1st, 4th, 6th, 8th, and 10th embodiments are of straight-expansion type that expand and contract while remaining straight and can be used even when made small in diameter, thereby being applicable to inner wiring in the thin tube, hole, gap, or small sized machine which has been impossible when employing conventional spiral elastic cables. Particularly, for the robot, internal wiring in the arm thereof has been made possible by such elastic cable as above, thereby safety and appearance being improved.

In comparison with the above-described elastic cables, the conventional elastic cables require a great length of wire for the manufacture thereof in a certain predetermined length and, therfore, is not only uneconomical in respect of manufacturing cost but also heavy in weight. The spirally wound conventional elastic wire, when applied to wiring outside the robot arm, hangs slack due to gravity and becomes dangerous when swung by turning robot arm, but an elastic cable of this invention solves such problems as above.

Elastic cables composed in the same way as that for the 2nd, 5th, 7th, 9th and 11th embodiments are of spirally wound type and large in outer diameter of coil thereof, however, significantly higher in elongation rate than that of the conventional spiral type cables. Accordingly, when maximum lengths of elongation exhibited by elastic cables of different types are equal to each other, the length of an elastic cable according to this invention in the state of non-elongation (no load) is far shorter than that of the conventional cable. The cable of this invention makes possible the reduction of manufacturing cost and most suitable for the use as, for example, the telephone transmitter-receiver cord.

Further, a structure as in the 3rd embodiment enables a cable to expand and contract while remaining straight and prevents noise generation.

Elastic cables as the 1st to 9th embodiments are excellent in resistance to expansion-contraction fatigue and also to deterioration by aging, in which conductors in the core cable are spirally wound like a coil and, therefore, cause no change in electric resistance and electric capacity even when stretched.

I claim:

1. An elastic electric cable comprising an elastic and deformable linear core member, wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering the outer surface of said conductor.

2. An elastic electric cable as set forth in claim 1, wherein said core member is provided with a longitudinally running hollow along the axis thereof.

3. An elastic electric cable as set forth in claim 1, wherein said core member is composed of an axial core part made of an elastic and deformable material and an outer layer part made of an elastic and deformable heat-resistant resinous material covering said axial core part wherein said outer layer part is provided with said longitudinally running protrusive ribs at the periphery thereof.

4. An elastic electric cable as set forth in claim 1 wherein said core member is star-shaped.

5. An elastic electric cable as set forth in claim 4 wherein said core member is provided with a longitudinally running hollow along the axis thereof.

6. An elastic electric cable comprising an elastic and deformable linear core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering the outer surface of said wound conductor, the entire body thereof being wound at close pitches like a coiled spring.

7. An elastic electric cable as set forth in claim 6, wherein a non-elastic yarn-composed body is interposed between said core member and said wound conductor and is spirally wound around said core member.

8. An elastic electric cable as set forth in claim 6, wherein a non-elastic yarn-composed body is interposed between said wound conductor and insulator and is spirally wound around said conductor.

9. An elastic electric cable as set forth in claim 6, wherein said core member is provided with a longitudinally running hollow along the axis thereof.

10. An elastic electric cable as set forth in claim 6, wherein said core member is composed of an axial core part made of an elastic and deformable material and an outer layer part made of an elastic and deformable material covering said axial core part and provided with said longitudinally running protrusive ribs at the outer periphery thereof.

11. An elastic electric cable as set forth in claim 6 wherein said core member is star-shaped.

12. An elastic electric cable as set forth in claim 11 wherein said core member is provided with a longitudinally running hollow along the axis thereof.

13. An elastic electric cable comprising an elastic and deformable linear core member wherein said core member is provided with longitudinally protrusive ribs at the periphery thereof, said ribs in cross section being generally triangular, trapezoidal or arcuate in shape, a conductor spirally wound around said core member, an insulator made of elastic and deformable material covering the outer surface of said spirally wound conductor, an outer conductor for noise prevention spirally wound around said insulator, and a sheath made of an elastic and deformable material covering said outer conductor.

14. An elastic electric cable as set forth in claim 13, wherein a non-elastic yarn-composed body is interposed between said core member and said wound conductor and is spirally wound around said core member.

15. An elastic electric cable as set forth in claim 13, wherein a non-elastic yarn-composed body is interposed between said wound conductor and said insulator and is spirally wound around said wound conductor.

16. An elastic electric cable as set forth in claim 13, wherein said core member is provided with a longitudinally running hollow along the axis thereof.

17. An elastic electric cable as set forth in claim 13, wherein said core member is composed of an axial core part made of an elastic and deformable material and an outer layer part made of an elastic and deformable heat-resistant resinous material covering said axial core part and provided with said longitudinally running protrusive ribs at the outer periphery thereof.

18. An elastic electric cable as set forth in claim 13 wherein said core member is star-shaped.

19. An elastic electric cable as set forth in claim 18 wherein said core member is provided with a longitudinally running hollow along the axis thereof.

20. An elastic electric cable comprising core cables each composed of an elastic and deformable linear core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering said wound conductor, in which a plurality of said core cables are aligned in parallel with each other and covered with a sheath made of elastic and deformable material at the outer periphery thereof.

21. An elastic electric cable as set forth in claim 20, wherein a non-elastic yarn-composed body is interposed between each said core member and said wound conductor and is spirally wound around each said core member.

22. An elastic electric cable as set forth in claim 20, wherein a non-elastic yarn-composed body is interposed between each said wound conductor and said insulator and is spirally wound around each said conductor.

23. An elastic electric cable as set forth in claim 20, wherein an outer conductor for noise prevention is wound around each said core cables.

24. An elastic electric cable as set forth in claim 20, wherein each said core member is provided with a longitudinally running hollow along the axis thereof.

25. An elastic electric cable as set forth in claim 20 wherein said core member is star-shaped.

26. An elastic electric cable as set forth in claim 25 wherein said core member is provided with a longitudinally running hollow along the axis thereof.

27. An elastic electric cable comprising core cables each composed of an elastic and deformable linear core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering said wound conductor, in which a plurality of said core cables are aligned in parallel with each other and a sheath made of an elastic and deformable material is provided covering the outer periphery of said parallel core cables, the entire body thereof being spirally wound at close pitches like a coiled spring.

28. An elastic electric cable as set forth in claim 27, wherein a non-elastic yarn-composed body is interposed between each said core member and wound conductor and is spirally wound around each said core member.

29. An elastic electric cable as set forth in claim 27, wherein a non-elastic yarn-composed body is interposed between each said wound conductor and insulator and is spirally wound around each said conductor.

30. An elastic electric cable as set forth in claim 27, wherein each said core member is provided with a longitudinally running hollow along the axis thereof.

31. An elastic electric cable as set forth in claim 27 wherein said core member is star-shaped.

32. An elastic electric cable as set forth in claim 31 wherein said core member is provided with a longitudinally running hollow along the axis thereof.

33. An elastic electric cable comprising core cables each composed of an elastic and deformable linear core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering said wound conductor, in which a plurality of said core cables are twisted together and a sheath made of an elastic, and deformable material is provided covering the outer periphery of said twisted core cables.

34. An elastic electric cable as set forth in claim 33, wherein a non-elastic yarn-composed body is interposed between each said core member and said wound conductor and is spirally wound around each said core member.

35. An elastic electric cable as set forth in claim 33, wherein a non-elastic yarn-composed body is interposed between each said wound conductor and said insulator and is spirally wound around each said conductor.

36. An elastic electric cable as set forth in claim 33, wherein an outer conductor for noise prevention is interposed between a plurality of said twisted core cables and sheath and is spirally wound around said twisted core cables.

37. An elastic electric cable as set forth in claim 33, wherein each said core member is provided with a longitudinally running hollow along the axis thereof.

38. An elastic electric cable as set forth in claim 33 wherein said core member is star-shaped.

39. An elastic electric cable as set forth in claim 38 wherein said core member is provided with a longitudinally running hollow along the axis thereof.

40. An elastic electric cable comprising elastic and deformable core cables each composed of an elastic and deformable core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering the outer surface of said wound conductor, in which a plurality of said core cables are twisted together and a sheath made of an elastic and deformable material is provided around said twisted core cables, the entire body thereof being spirally wound like a coiled spring.

41. An elastic electric cable as set forth in claim 40, wherein a non-elastic yarn-composed body is interposed between each said core member and said wound conductor and is spirally wound around each said core member.

42. An elastic electric cable as set forth in claim 40, wherein a non-elastic yarn-composed body is interposed between each said wound conductor and said insulator and is sprially wound around each said conductor.

43. An elastic electric cable as set forth in claim 40, wherein each said core member is provided with a longitudinally running hollow along the axis thereof.

44. An elastic electric cable as set forth in claim 40 wherein said core member is star-shaped.

45. An elastic electric cable as set forth in claim 44, wherein said core member is provided with a longitudinally running hollow along the axis thereof.

46. An elastic electric cable comprising elastic and deformable core cables each composed of an elastic and deformable core member wherein said core member is provided with longitudinally protrusive ribs at the periphery thereof, said ribs in cross section being generally triangular, trapezoidal or arcuate in shape, a conductor spirally wound aournd said core member, and an insulator made of an elastic and deformable material covering the outer surface of said wound conductor, in which a plurality of said core cables are spirally wound together and a sheath made of an elastic and deformable material is provided around said spirally wound core cables.

47. An elastic electric cable as set forth in claim 46, wherein a non-elastic yarn-composed body is interposed between each said core member and said wound conductor and is spirally wound around each said core member.

48. An elastic electric cable as set forth in claim 46, wherein a non-elastic yarn-composed body is interposed between each said wound conductor and insulator and is spirally wound around each said conductor.

49. An elastic electric cable as set forth in claim 46, wherein each said core member is provided with a longitudinally running hollow along the axis thereof.

50. An elastic electric cable as set forth in claim 46 wherein said core member is star-shaped.

51. An elastic electric cable as set forth in claim 50 wherein said core member is provided with a longitudinally running hollow along the axis thereof.

52. An elastic electric cable comprising elastic and deformable core cables each composed of an elastic and deformable linear core member wherein said core member is provided with longitudinally protrusive ribs at the periphery thereof, said ribs in cross section being generally triangular, trapezoidal or arcuate in shape, a conductor spirally wound around said core member, and an insulator made of an elastic and deformable material covering the outer surface of said wound conductor, in which a plurality of core cables are spirally wound and a sheath made of an elastic and deformable material is provided around said core cables, the entire body thereof being spirally wound at close pitches like a coiled spring.

53. An elastic electric cable as set forth in claim 52, wherein a non-elastic yarn-composed body is interposed between each said core member and wound conductor and is spirally wound around each said core member.

54. An elastic electric cable as set forth in claim 52, wherein a non-elastic yarn-composed body is interposed between each said wound conductor and insulator and is spirally wound around each said conductor.

55. An elastic electric cable as set forth in claim 52, wherein each said core member is provided with a longitudinally running hollow along the axis thereof.

56. An elastic electric cable as set forth in claim 52 wherein said core member is star-shaped.

57. An elastic electric cable as set forth in claim 56 wherein said core member is provided with a longitudinally running hollow along the axis thereof.

* * * * *